US007448303B2

(12) United States Patent
Sweat et al.

(10) Patent No.: US 7,448,303 B2
(45) Date of Patent: Nov. 11, 2008

(54) PIPE EXTRACTION TOOL

(76) Inventors: Ryan V. Sweat, 4117 E. Center Creek Rd., Heber, UT (US) 84032; Douglas R. Allred, 2380 E. 2400 So., Heber, UT (US) 84032

( * ) Notice: Subject to any disclaimer, the term of this patent is extended or adjusted under 35 U.S.C. 154(b) by 0 days.

(21) Appl. No.: 11/745,150

(22) Filed: May 7, 2007

(65) Prior Publication Data

US 2008/0115633 A1 May 22, 2008

Related U.S. Application Data

(60) Provisional application No. 60/867,063, filed on Nov. 22, 2006, provisional application No. 60/887,068, filed on Jan. 29, 2007.

(51) Int. Cl.
*B25B 13/54* (2006.01)
*B25B 27/00* (2006.01)
*E21B 19/06* (2006.01)

(52) U.S. Cl. ..... 81/444; 81/3.05; 294/96

(58) Field of Classification Search ..... 81/444, 81/443, 446, 452, 453, 455, 3.05, 448; 294/94–96, 294/116

See application file for complete search history.

(56) References Cited

U.S. PATENT DOCUMENTS

| | | | | | |
|---|---|---|---|---|---|
| 1,958,330 | A | * | 5/1934 | Beard | 294/95 |
| 2,116,770 | A | | 5/1938 | Scillia | |
| 2,360,054 | A | * | 10/1944 | Haas | 81/444 |
| 2,678,217 | A | * | 5/1954 | King | 81/444 |
| 2,736,286 | A | * | 2/1956 | Britton | 81/444 |
| 2,814,098 | A | * | 11/1957 | Kessell | 81/444 |
| 3,071,848 | A | * | 1/1963 | Lawry et al. | 29/267 |
| 3,709,546 | A | * | 1/1973 | Vaughan | 294/96 |
| 3,891,181 | A | | 6/1975 | Sanders | |
| 3,952,618 | A | | 4/1976 | Seamon | |
| 4,019,237 | A | * | 4/1977 | DeRee | 29/221.6 |
| 4,093,179 | A | | 6/1978 | Schmidt | |
| 4,334,443 | A | | 6/1982 | Pearson | |
| 4,377,956 | A | | 3/1983 | Cooper | |
| 4,546,679 | A | | 10/1985 | Burghardt | |
| D329,969 | S | | 10/1992 | Kemp | |
| D364,542 | S | | 11/1995 | Pollard | |
| 6,349,624 | B1 | | 2/2002 | Fahringer | |
| 6,446,531 | B1 | | 9/2002 | Colombani | |
| 6,626,616 | B2 | | 9/2003 | Costa | |
| D480,933 | S | | 10/2003 | Wendt | |

* cited by examiner

*Primary Examiner*—Hadi Shakeri
(74) *Attorney, Agent, or Firm*—Bateman IP Law Group

(57) ABSTRACT

A pipe extraction tool grips the inside of a pipe or other such conduit to facilitate removal of a pipe which can not otherwise be removed. The extraction tool uses expandable jaws to grip the inside of the pipe.

6 Claims, 16 Drawing Sheets

PIPE EXTRACTION TOOL

RELATED APPLICATIONS

The present application claims the benefit of U.S. Provisional Application Ser. No. 60/867,063, filed Nov. 22, 2006, which is expressly incorporated herein in its entirety, and U.S. Provisional Application Ser. No. 60/887,068, filed Jan. 29, 2007, which is expressly incorporated herein in its entirety.

BACKGROUND OF THE INVENTION

1. The Field of the Invention

The present invention relates to a pipe extraction tool. More specifically, the present invention relates to a tool for extracting pipe or the like by gripping the inside of the pipe to facilitate removal thereof.

2. State of the Art

Pipes are used in many situations, such as irrigation pipes, water supply lines, gas pipes, etc. Commonly, pipes are used which are threaded, and which are screwed into a fitting such as an elbow or tee to connect the pipe together. Often, a system of pipe includes a permanent system of pipe to distribute fluids to desired locations, and threaded inserts at these locations to allow the connection of a valve, sprinkler head, etc. to the pipe. The distribution pipe is often soldered or glued together, and is difficult to repair. The sprinklers heads, valves, etc. are often connected by a short piece of pipe such as a riser or standoff, which is typically threaded into the distribution pipe.

It is not uncommon for a pipe to break. For example, sprinkler/irrigation pipes are often broken when a lawn mower, tractor, or other vehicle accidentally drives over a sprinkler head. In such a situation, the standoff or riser is often broken at or near the connection to the distribution pipe. It is often difficult to remove the broken pipe, as it often breaks underground.

Thus, it may be necessary to dig a hole to expose the connection between the riser pipe and the distribution pipe and remove and replace the riser pipe. It is often difficult to remove the riser pipe even after exposing the connection, as the riser may break off at the threaded end of the riser, as the threaded section is weaker than the rest of the pipe. Thus, there may be very little if any of the riser pipe extending from the distribution pipe.

There is thus a need for a pipe extraction tool which allows for the removal of pipe or the like when little or none of the pipe exterior is exposed. There is a need for a pipe extraction tool which allows for removal of pipes without requiring a person to dig up or otherwise expose the pipe.

SUMMARY OF THE INVENTION

It is an object of the present invention to provide an improved pipe extraction tool.

According to one aspect of the invention, a pipe extraction tool is provided with a head which is inserted into a pipe, and with jaws which grip the inside of the pipe. The extraction tool may use a tapered wedge which is moved to expand the jaws into the pipe. Such an extraction tool provides a high gripping force and may be used to remove large pipe, or pipe which is rusted or otherwise stuck.

The extraction tool may also be provided with a stop to automatically position the tool at a proper depth in the pipe, and may include a biasing element to bias the jaws to a non-gripping position. Such features make the extraction tool easier to use, especially where the pipe is underground or otherwise inaccessible.

These and other aspects of the present invention are realized in a pipe extraction tool as shown and described in the following figure and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single FIGURE, and as such, multiple figures are presented to separately illustrate the various details of the invention in greater clarity.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1A:
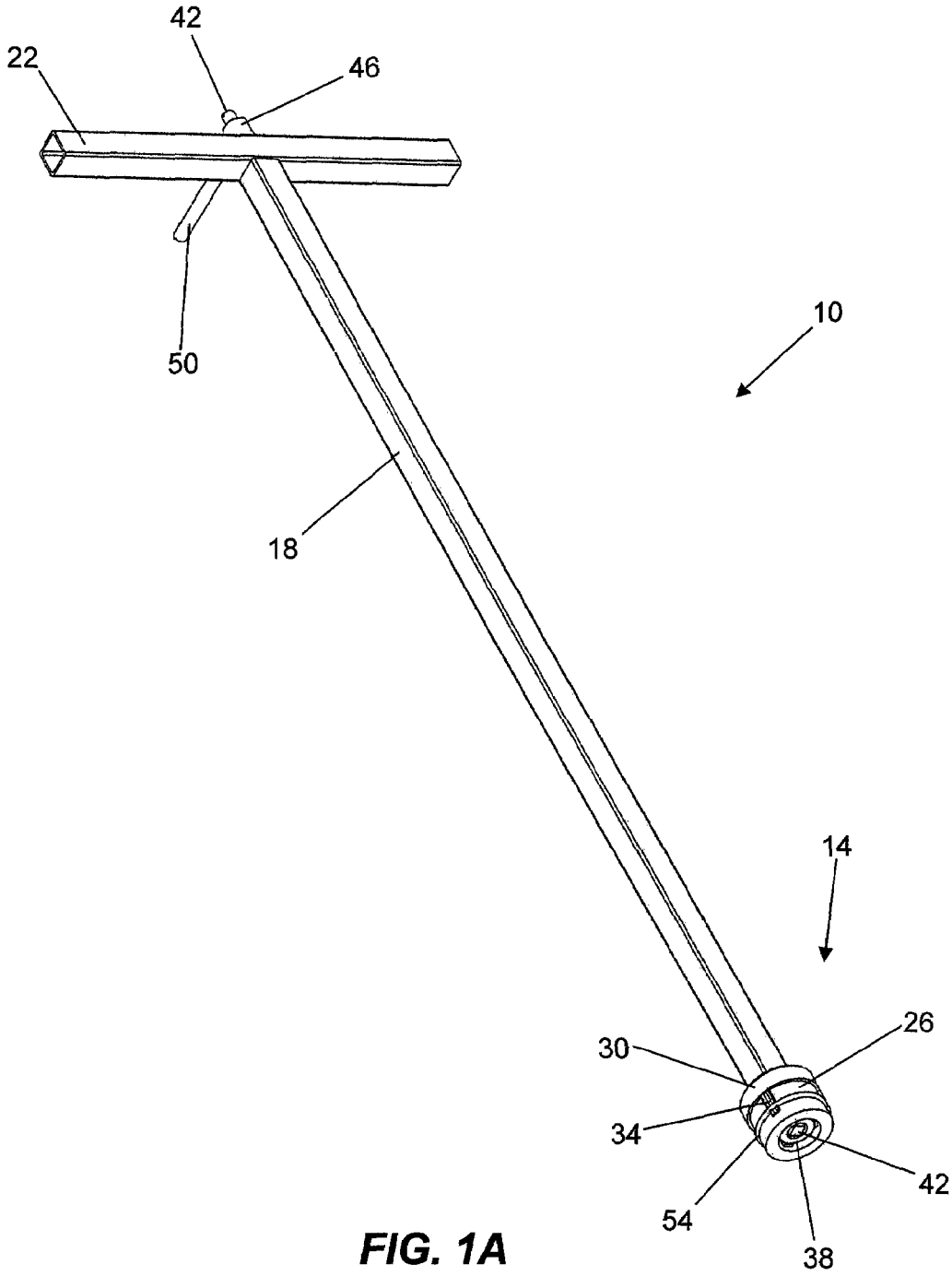
FIG. 1A shows a perspective view of the pipe extraction tool of the present invention.

FIG. 1A shows a perspective view of the pipe extraction tool of the present invention. The extraction tool 10 includes a wrench head 14, stem 18, and handle 22. The wrench head 14 engages the inside of a pipe or the like to remove the same. The stem 18 allows the wrench head 14 to reach a pipe which is underground or otherwise inaccessible, and the handle 22 allows a person to provide sufficient torque to remove a pipe.

The extraction tool 10 shown is about 53 inches long. As discussed herein, example dimensions are provided for an extraction tool 10 capable of removing a pipe with about a 2.75 inch diameter. It is appreciated that the tool 10 may be made in different sizes to accommodate different sizes of pipe, and in different lengths as is desired. It may be desirable to make different lengths for different sizes of pipe. When removing a relatively large sprinkler standoff, for example, it may be easier to have a long extraction tool 10 which may be inserted into the ground to reach the pipe, and which may be used by one or two persons while standing to achieve greater force. For an extraction tool 10 for removing smaller pipe, it may be desirable to have an overall tool length of about 12 or 24 inches for ease of use.

The wrench head 14 includes a wrench body 26 and a wrench cap 30. The wrench body 26 has openings to receive a plurality of wrench jaws 34 which are expandable from the wrench body 26 to grip the inside of a pipe. The wrench jaws 34 are expanded outwardly by a wedge 38 and a draw bar or screw 42 and screw nut 46 which are used to pull the wedge upwardly within the wrench body 26. The screw 42 passes through the stem 18 such that the wrench jaws 34 may be expanded to grip a pipe by using a screw nut 46 and screw nut handle 50 which are adjacent the handle 22. An O-ring 54 may be used to bias the wrench jaws 34 into the wrench body 26 in a non-griping configuration.

Figure 1B:
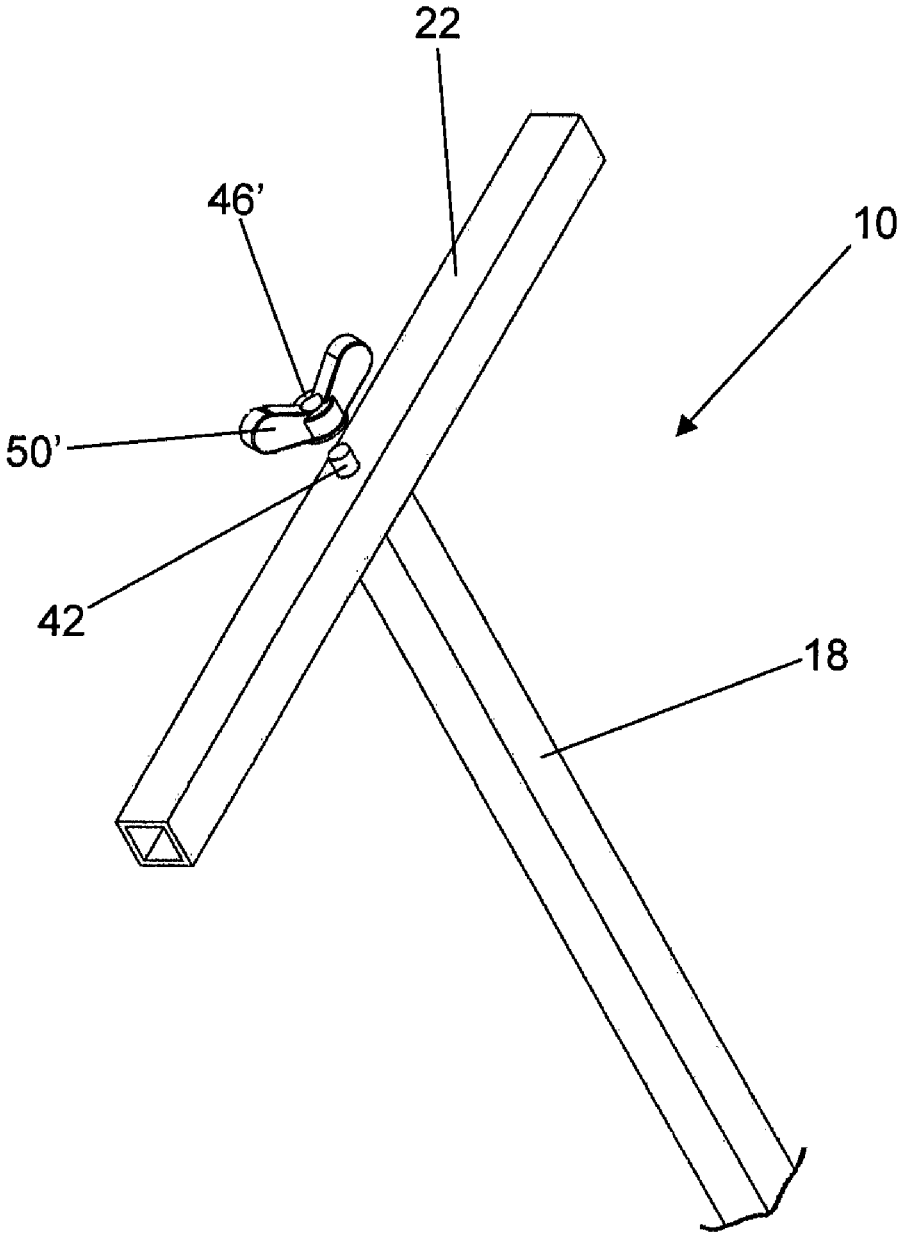
FIG. 1B shows a partial perspective view of the tool of FIG. 1A having a different locking nut.

FIG. 1B shows a partial perspective view of the tool 10 of FIG. 1A. The tool 10 utilizes a screw nut 46' with a handle 50; which is shaped like a wing nut. It will be appreciated that a variety of different shapes of screw nut 46 may be used.

Figure 2:
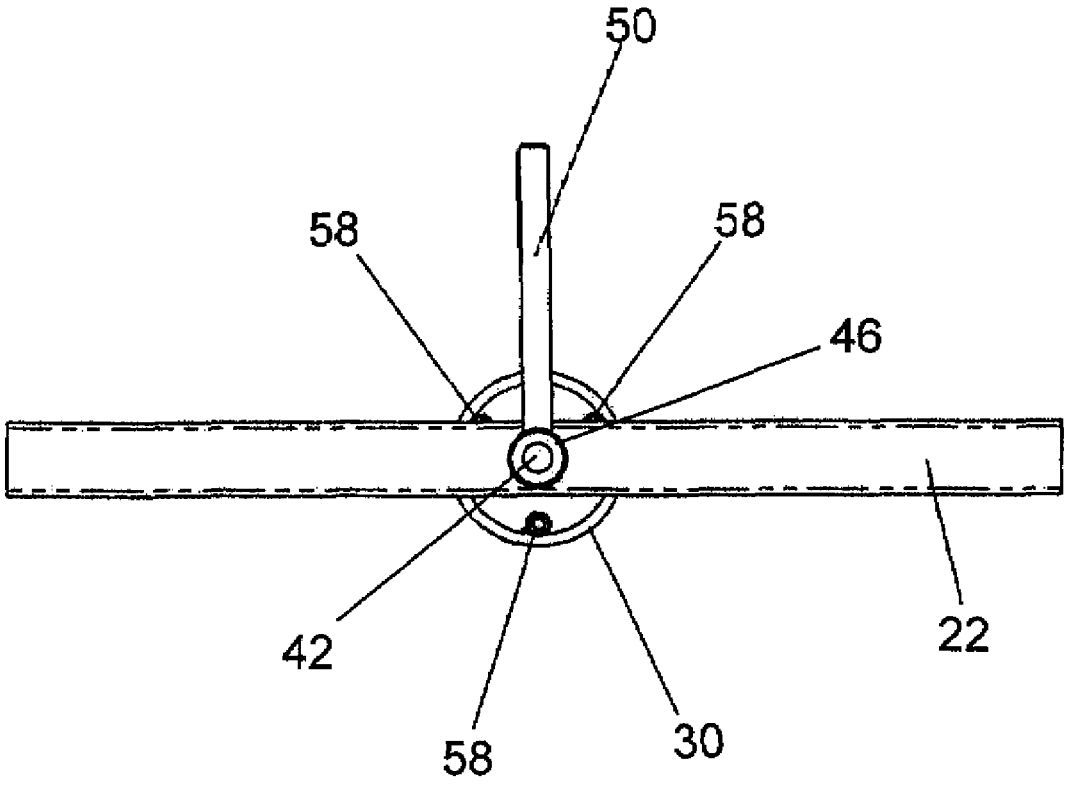
FIG. 2 shows a top view of the extraction tool of FIG. 1A.

FIG. 2 shows a top view of the extraction tool 10 of FIG. 1A. It can be better seen how the screw nut 46 and screw nut handle 50 are in a convenient position for use. FIG. 2 also illustrates bolts 58 used to hold the wrench body 26 and wrench cap 30 together.

Figure 3:
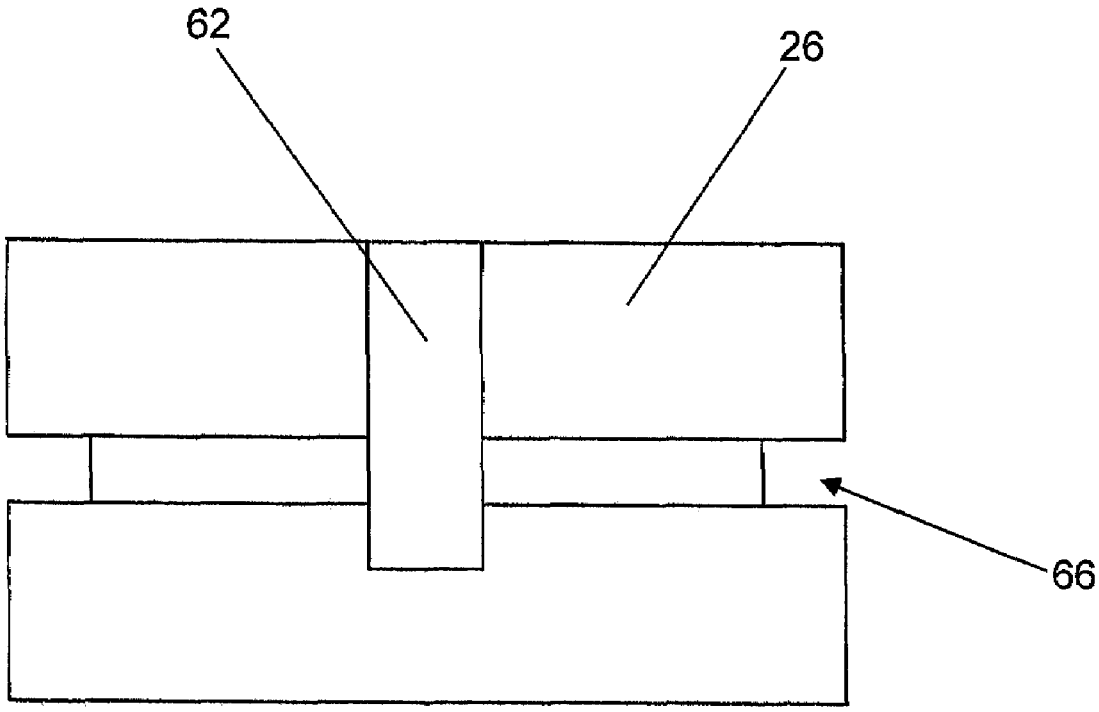
FIG. 3 shows a side view of the wrench body of FIG. 1A.

FIG. 3 shows a side view of the wrench body of FIG. 1A. The wrench body 26 has slots 62 for receiving the wrench jaws 34. The wrench body 26 also has a groove 66 which receives the O-ring 54, allowing the O-ring to sit beneath the surface of the wrench body 26. For the size illustrated herein, the wrench body is about 2.75 inches in diameter. The slots 62 are about 0.38 inches wide and 1.06 inches deep. The groove 66 is about 0.22 inches wide and about 0.25 inches deep.

Figure 4:
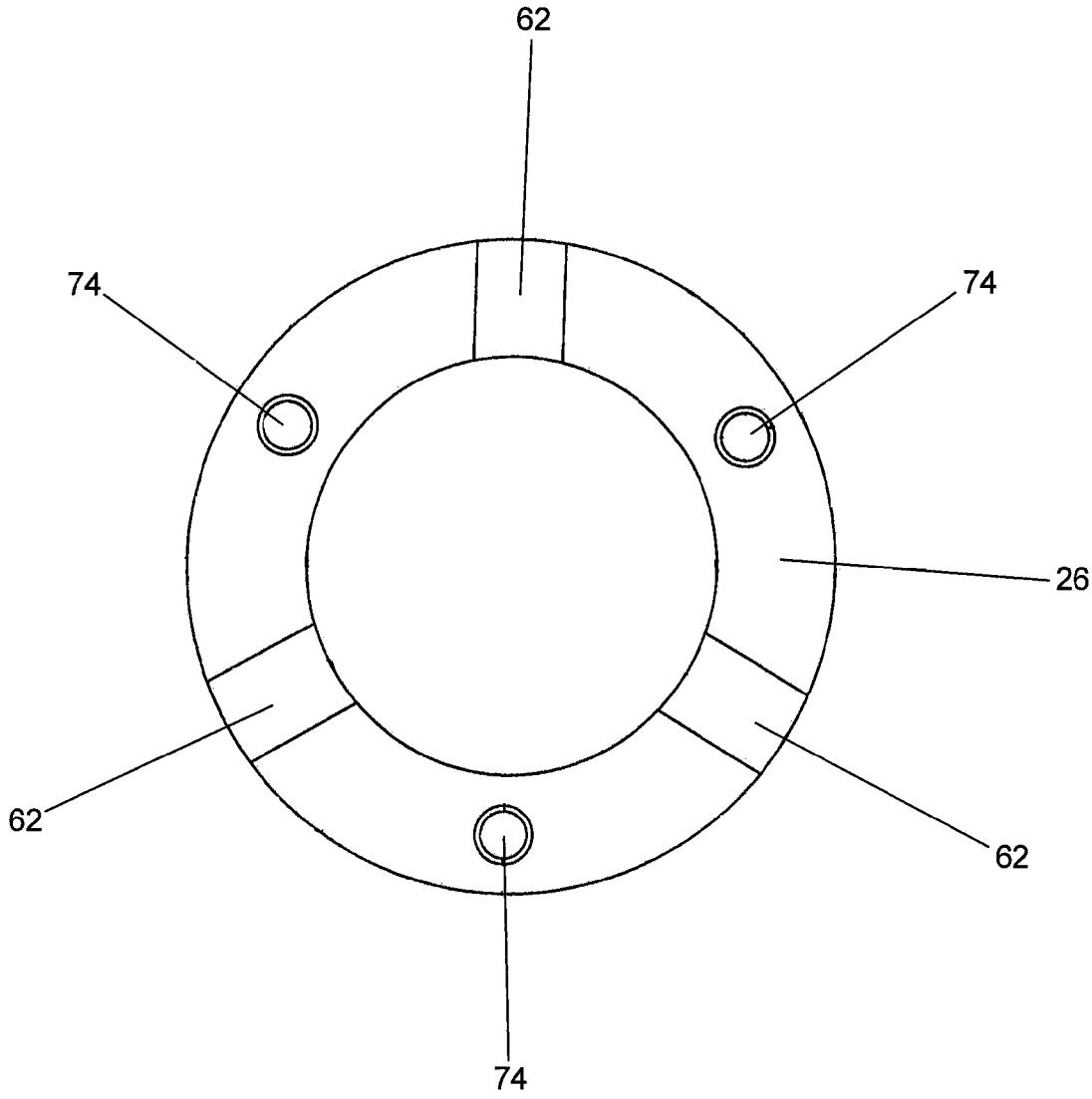
FIG. 4 shows a top view of the wrench body of FIG. 3.

FIG. 4 shows a top view of the wrench body of FIG. 3. It can be seen how the interior 70 of the wrench body 26 is hollow to receive the wrench jaws 34 and the wedge 38. The wrench body also includes threaded holes 74 to facilitate attachment to the wrench cap 30. For the size of tool shown herein, the interior 70 of the wrench body 26 has a diameter of about 1.75 inches.

Figure 5:
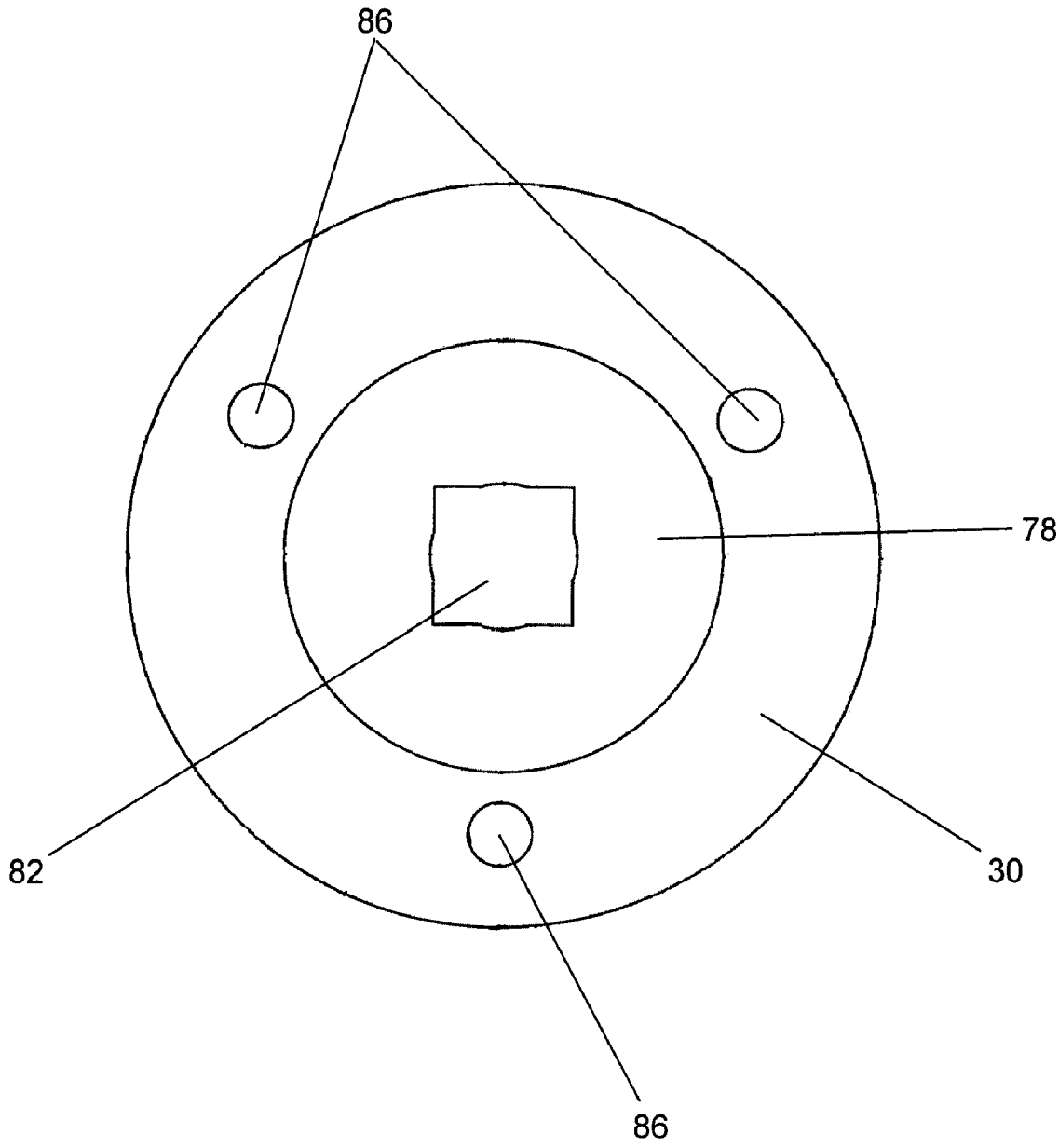
FIG. 5 shows a bottom view of the wrench cap of FIG. 1A.

FIG. 5 shows a bottom view of the wrench cap 30 of FIG. 1A, which is attached to the stem 18. The wrench cap 30 includes an internal recess of about 1.75 inches in diameter and about 0.63 inches deep. A square hole 82 of about 0.6 inches is formed through the center of the wrench cap 30. The screw 42 has an unthreaded square portion which passes through the hole 82. The unthreaded portion of the screw 42 has a square shaft which, in combination with the square hole 82, prevents rotation of the screw. Thus, the screw moves linearly through the hole 82. Holes 86 are provided to allow for attachment to the wrench body 26.

The wrench cap 30 is about 3 inches in diameter, and is larger in diameter than the wrench body 26. The wrench cap provides a stop, and does not allow the wrench 14 to be inserted too far into the pipe. If the wrench 14 is inserted too far into the pipe, it may pass through the pipe and not grip the pipe. Thus the present invention is particularly useful in removing sprinkler and irrigation risers which have broken off beneath the ground.

Figure 6:
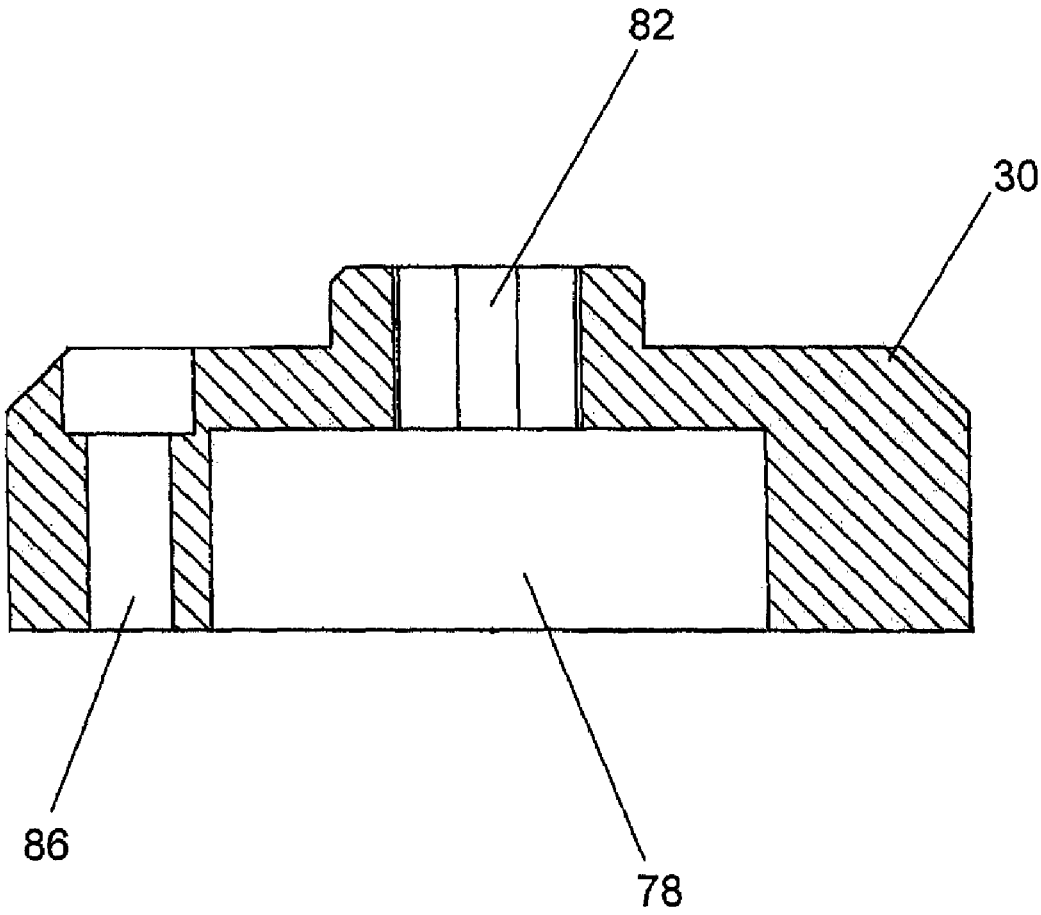
FIG. 6 shows a cross-sectional view of the wrench cap of FIG. 5.

FIG. 6 shows a cross-sectional view of the wrench cap of FIG. 5. The recess 78 and hole 82 of the wrench cap 30 may be better seen. It can also be seen how the holes 86 may be countersunk to receive the head of the bolts 58 (FIG. 2) used to attach the wrench cap 30 and wrench body 26.

Figure 7:
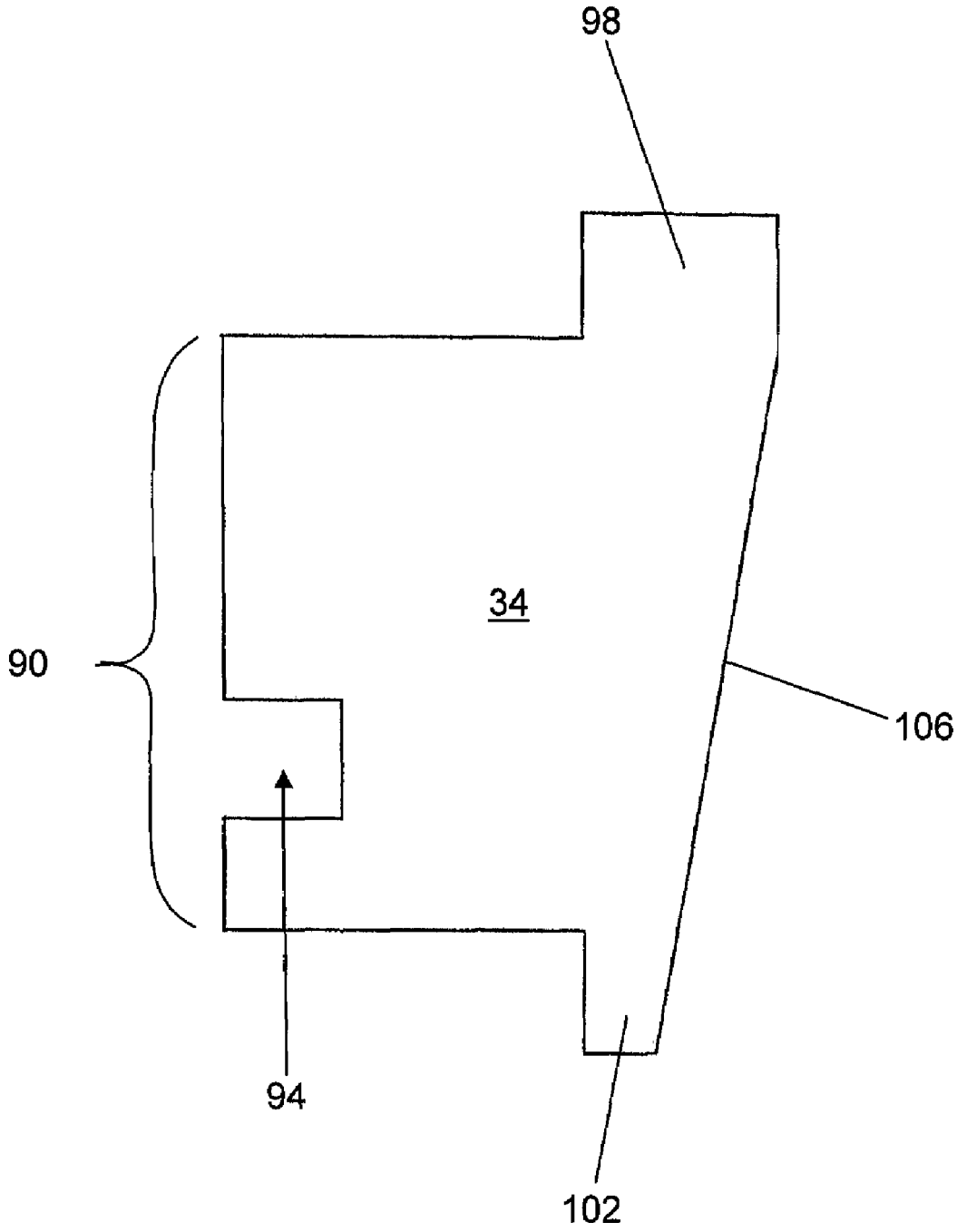
FIG. 7 shows a side view of a wrench jaw of FIG. 1A.

FIG. 7 shows a side view of a wrench jaw of FIG. 1A. The wrench jaw 34 has a pipe engaging portion 90 about 1.05 inches long which extends through a slot 62 in wrench body 26 to grip a pipe. A notch 94 of about 0.2 inches width and depth may be formed therein for receiving the O-ring 54 of FIG. 1A such that the O-ring is not cut when the jaw 34 engages a pipe.

The wrench jaw 34 has a first tab 98 which is received within the recess 78 of the wrench cap 30 and a second tab 102 which is disposed in the opening 70 in the wrench body 26. The tabs 98, 102 aid in locating the jaw 34 and ensure that the jaw does not pass completely through the slot 62 in the wrench body 26. An inclined surface 106, formed at an angle of about 10 degrees for example, engages the wedge 38 and is used to push the jaw 34 outwardly against a pipe.

Figure 8:
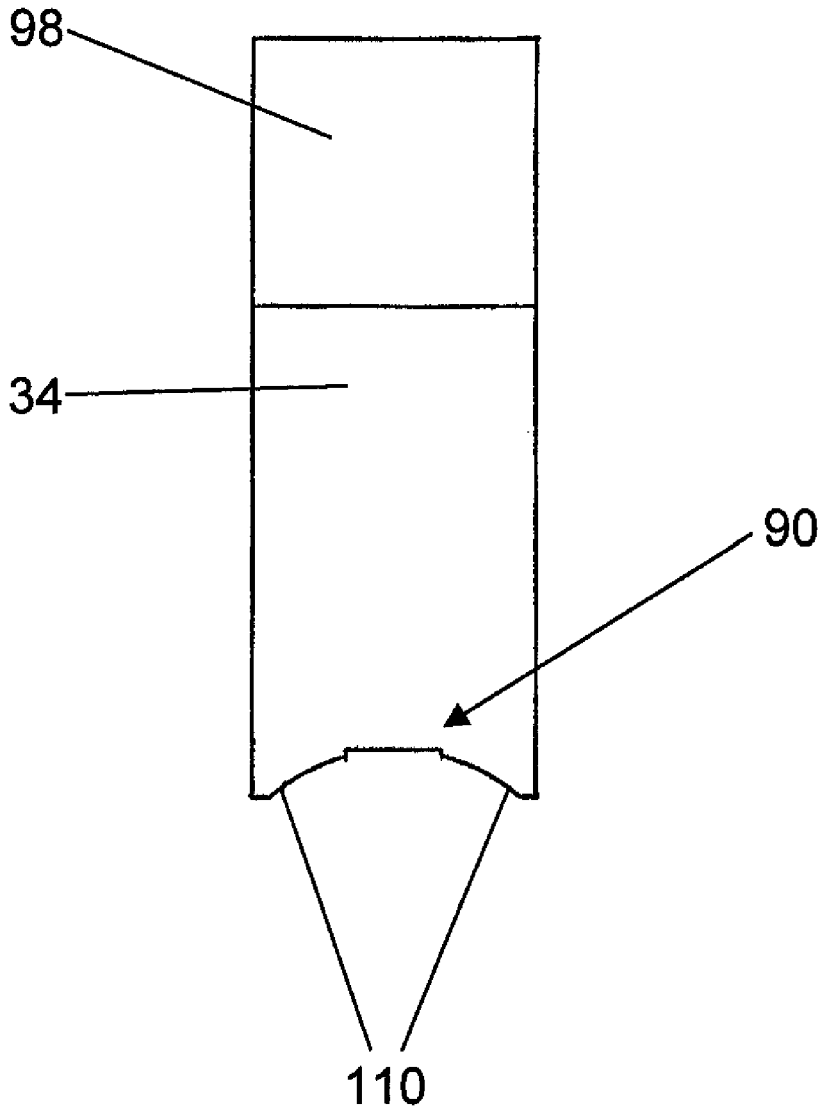
FIG. 8 shows an end view of the wrench jaw of FIG. 7.

FIG. 8 shows a top view of the wrench jaw of FIG. 7, illustrating how the pipe engaging portion 90 may be formed to have teeth 110 which aid in gripping a pipe. It will be appreciated that the engaging portion need not be formed in a concave shape as shown. If the engaging portion is simply cut flat, the corners thereof will still form relatively sharp edges which will engage the inside bore of a pipe to grip the pipe. The extraction tool 10 may be used for a variety of pipe materials, including plastic, iron, copper, etc. The present design uses three jaws 34 to aid in gripping the pipe and in automatically centering the extraction tool 10 in the pipe.

Figure 9:
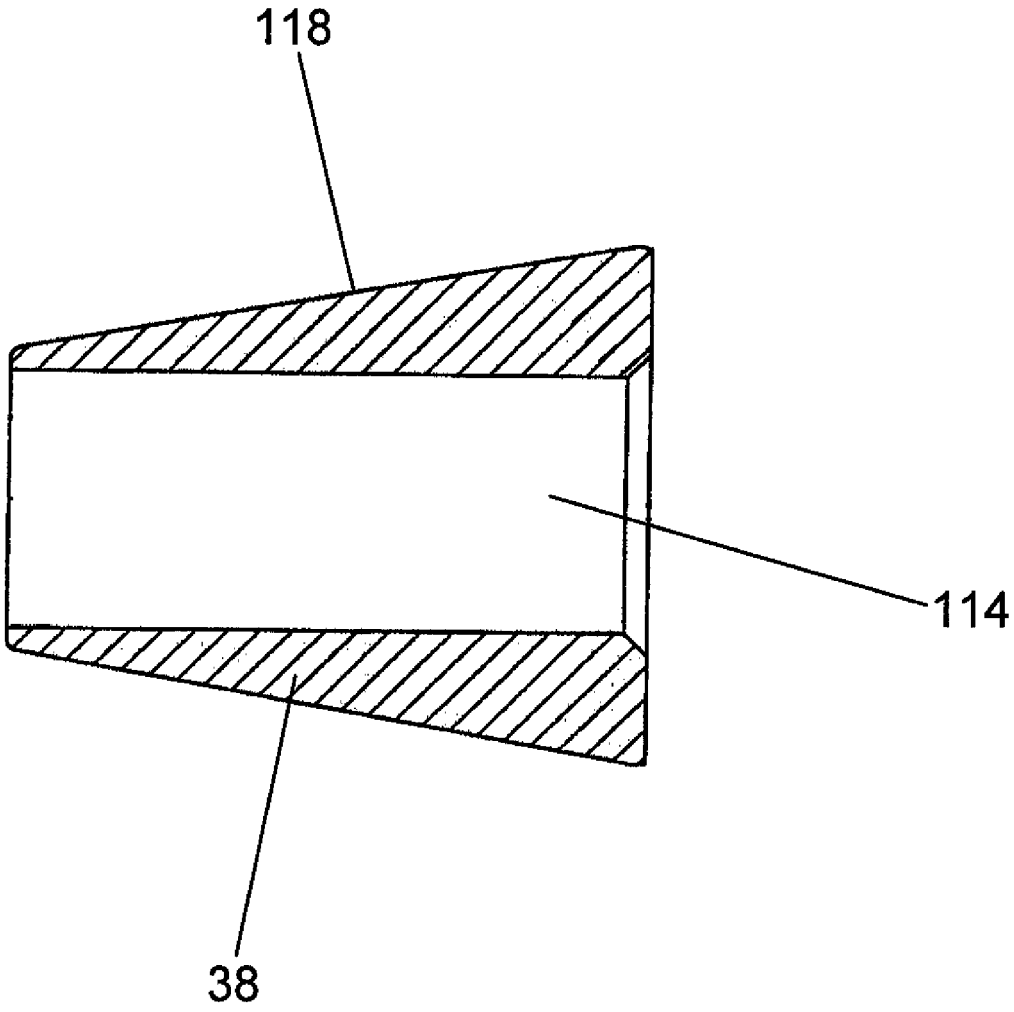
FIG. 9 shows a cross-sectional view of the wedge of FIG. 1A.

FIG. 9 shows a cross-sectional view of the wedge of FIG. 1A. The wedge 38 is a frusto-conical or cone shaped member having a tapered outer surface 118 of approximately the same angle as is formed in inclined surface 106 of the wrench jaws 34. Thus, as the wedge 38 is drawn upwardly into the wrench body 26, the jaws 34 are forced outwardly to grip a pipe. Preferably, the wrench jaws slide linearly to engage the pipe. Thus, the maximum engagement between the teeth 110 and the and the pipe is achieved.

The wedge 38 has a hole 114 there through for receiving the screw 42, and the wedge 38 is at a fixed position along the length of the screw 42. Thus, drawing the screw 42 upwardly through the tool 10 also draws the wedge upwardly through the wrench body 26, pushing the jaws 34 outwardly as surfaces 106 and 118 interact.

Figure 10:
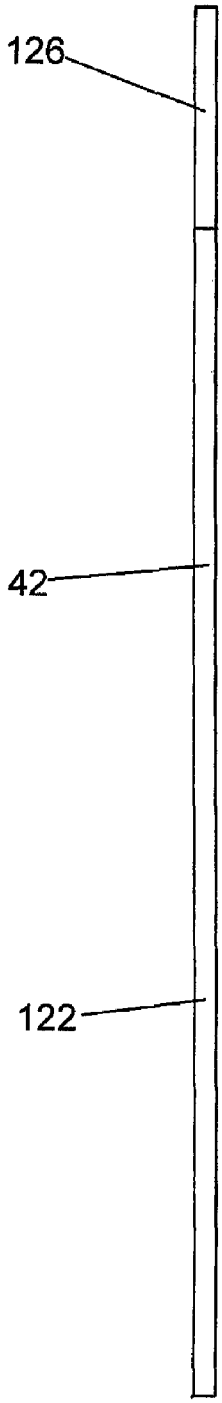
FIG. 10 shows a side view of the screw of FIG. 1A.

FIG. 10 shows a side view of the screw of FIG. 1A. The screw 42 includes a body 122, preferably with a square cross section, and a cylindrical threaded end 126. The threaded end 126 engages the screw nut 46. The square body 122 passes through the square hole 82 in the wrench cap 30, preventing rotation of the screw 42.

Figure 11:
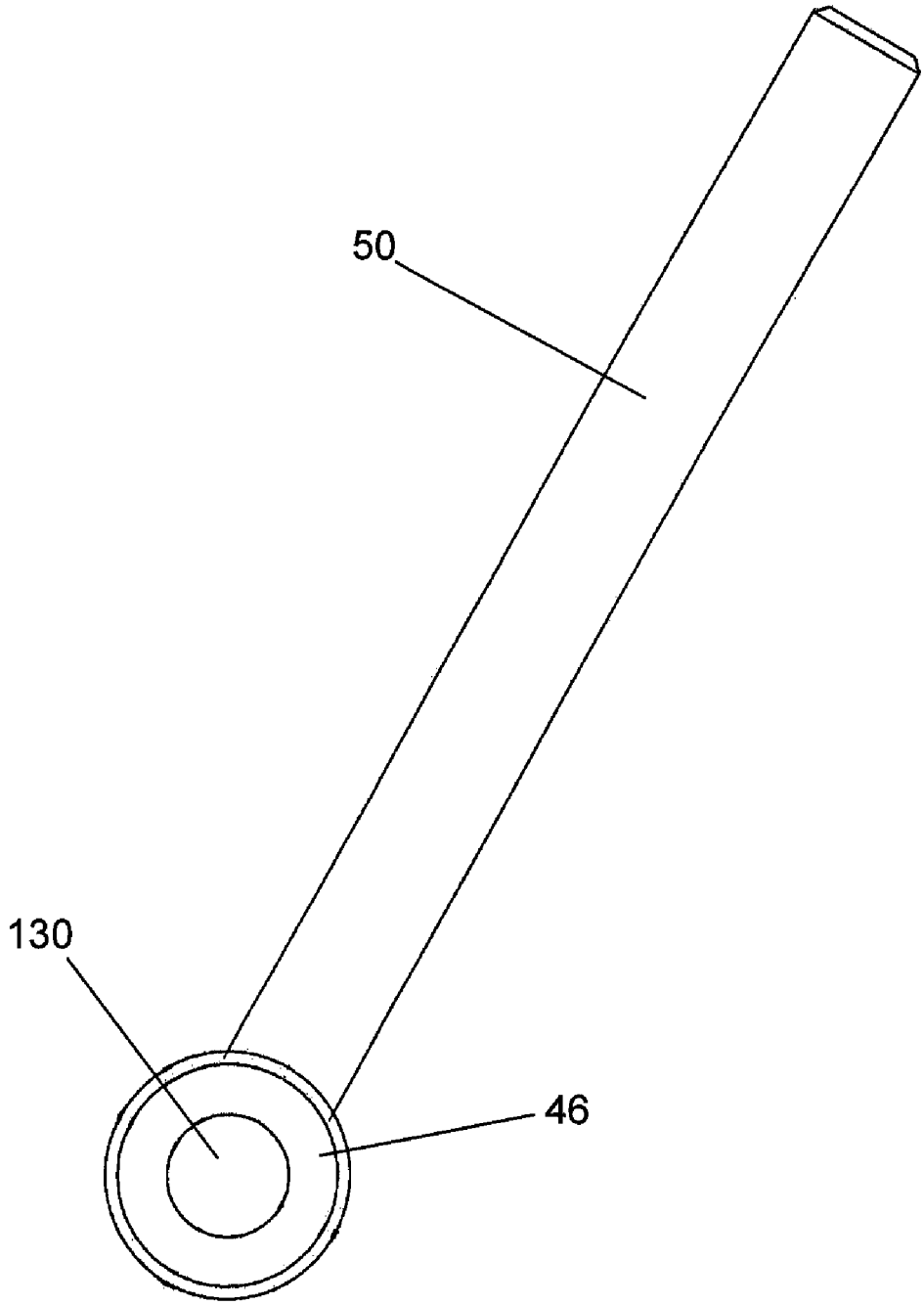
FIG. 11 shows a top view of the screw nut of FIG. 1A.

FIG. 11 shows a top view of the screw nut of FIG. 1A. The screw nut 46 includes a threaded hole 130 which is threaded onto the threaded end 126 of the screw 42. A handle 50 is used to rotate the screw nut 46.

Figure 12:
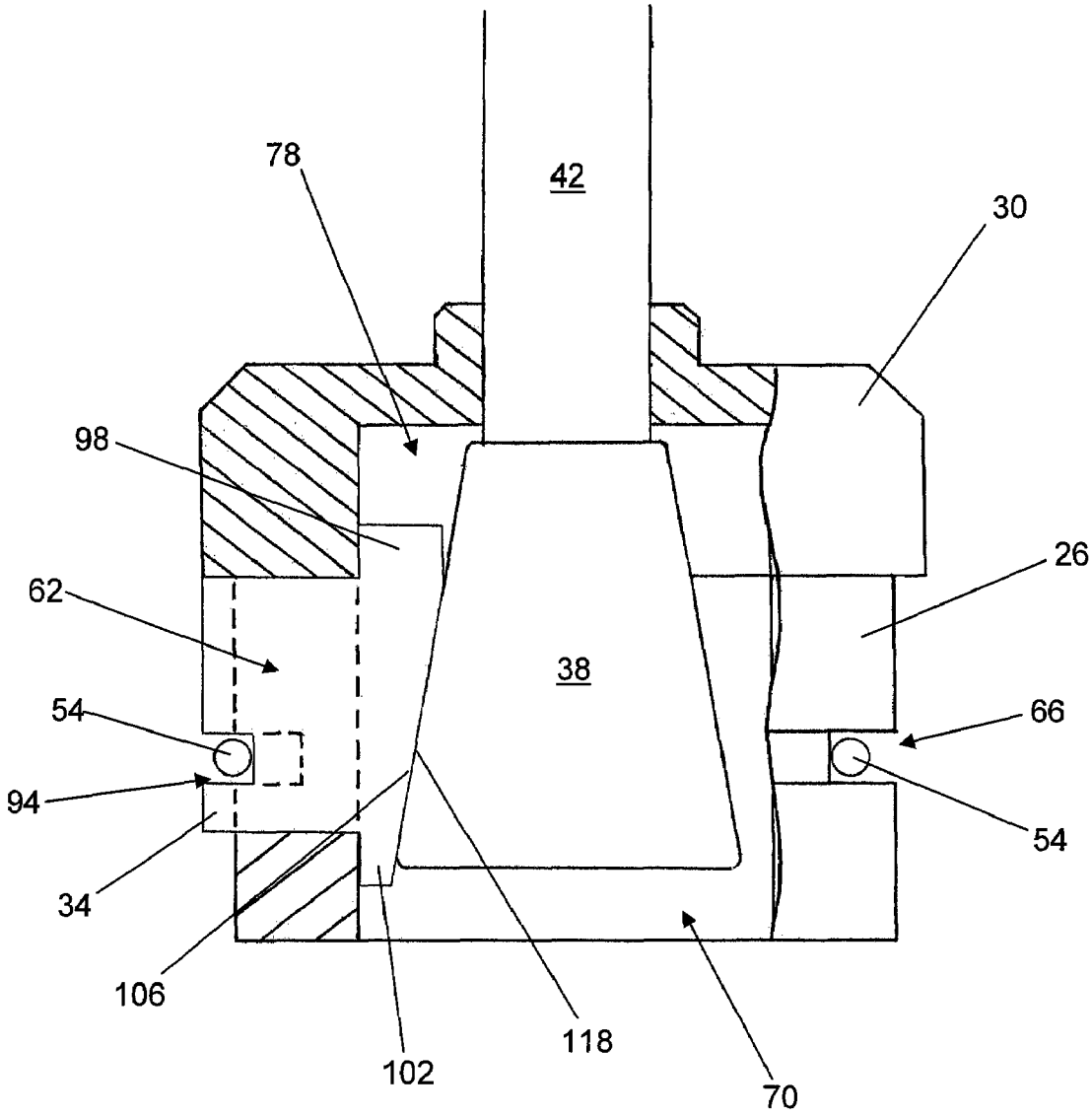
FIG. 12 shows a partial cut-away view of the wrench of FIG. 1A.

Referring now to FIG. 12 and also back to FIG. 1A, the assembled extraction tool 10 is seen. FIG. 12 shows a partial cut away view of the tool 10, omitting the stem 18 for clarity. Following the discussion of the various pieces of the tool 10, the construction and operation of the tool is more easily understood. The wrench top 30 is attached to the stem 18, and the wrench body 26 is attached to the wrench top with the wrench jaws 34 extending outwardly through the slots 62 of the wrench body. The slots are indicated by a dashed outline in FIG. 12. The wedge 38 nests in the open interior 70 of the wrench body between the inclined surfaces 106 of the wrench jaws 34.

The screw 42 is attached to the wedge 38 and passes through the stem 18 and handle 22. The screw nut 46 is attached to the threaded end 126 of the screw 42. Tightening the screw nut 46 via handle 50 draws the screw 42 up through the stem 18 and wrench 14, drawing the wedge 38 further into the open interior 70 of the wrench body 26 and extending the wrench jaws 34 outwardly to grip a pipe. Loosening the screw nut 46 allows the screw 42 and wedge 38 to slide back down through the stem and release the wrench jaws 34, allowing the O-ring 54 to move the jaws back into the wrench body 26. FIG. 12 shows the jaws 34 (only one shown for clarity) in an extended position. It can be seen that the O-ring 54 is stretched away from the groove 66 in the wrench body 26 by the jaw 34, and as such will exert a restoring force on the jaws 34 to pull them back into the wrench body 26 when the screw nut 46 is loosened.

It is appreciated that the wedge 38 could be reversed so as to be wider on top and narrower on the bottom, and that the tapered surfaces 106 on the wrench jaws 34 could be similarly reversed such that the wedge is pushed downwardly to extend the jaws. For such a configuration, the screw 42 would likely rotate in the wrench and the stem 18 or handle 22 would contain a threaded portion such that as the screw 42 rotates, it is forced downwardly. The screw nut would be eliminated and the screw nut handle 50 would typically be attached directly to the screw 42 to rotate the screw. The configuration shows is, however, advantageous as it places the screw 42 in tension and does not present any buckling concerns when the wrench 14 is tightened.

In use, a person would insert the wrench head 14 into a pipe, such as a broken pipe. If the pipe is broken underground, for example, the person may pull the broken off piece of the pipe out of the ground and insert the wrench head 14 into the resulting hole in the ground and into the remaining piece of pipe. When inserting the wrench head 14 into the pipe, the wrench top 30 provides a depth stop as it is larger diameter than the pipe bore, and the wrench body 26 is a smaller diameter than the pipe bore. It is appreciated that different sizes of extraction tools 10 may be made to accommodate different sizes of pipes, and may be made to accommodate a range of pipe sizes.

Once the wrench head 14 is inserted into the pipe, the handle 50 is used to tighten the screw nut 46 and draw the screw 42 upwardly through the wrench to extend the jaws 34 and thereby grip the broken pipe. The broken pipe is then rotated out of the distribution pipe.

Figure 13:
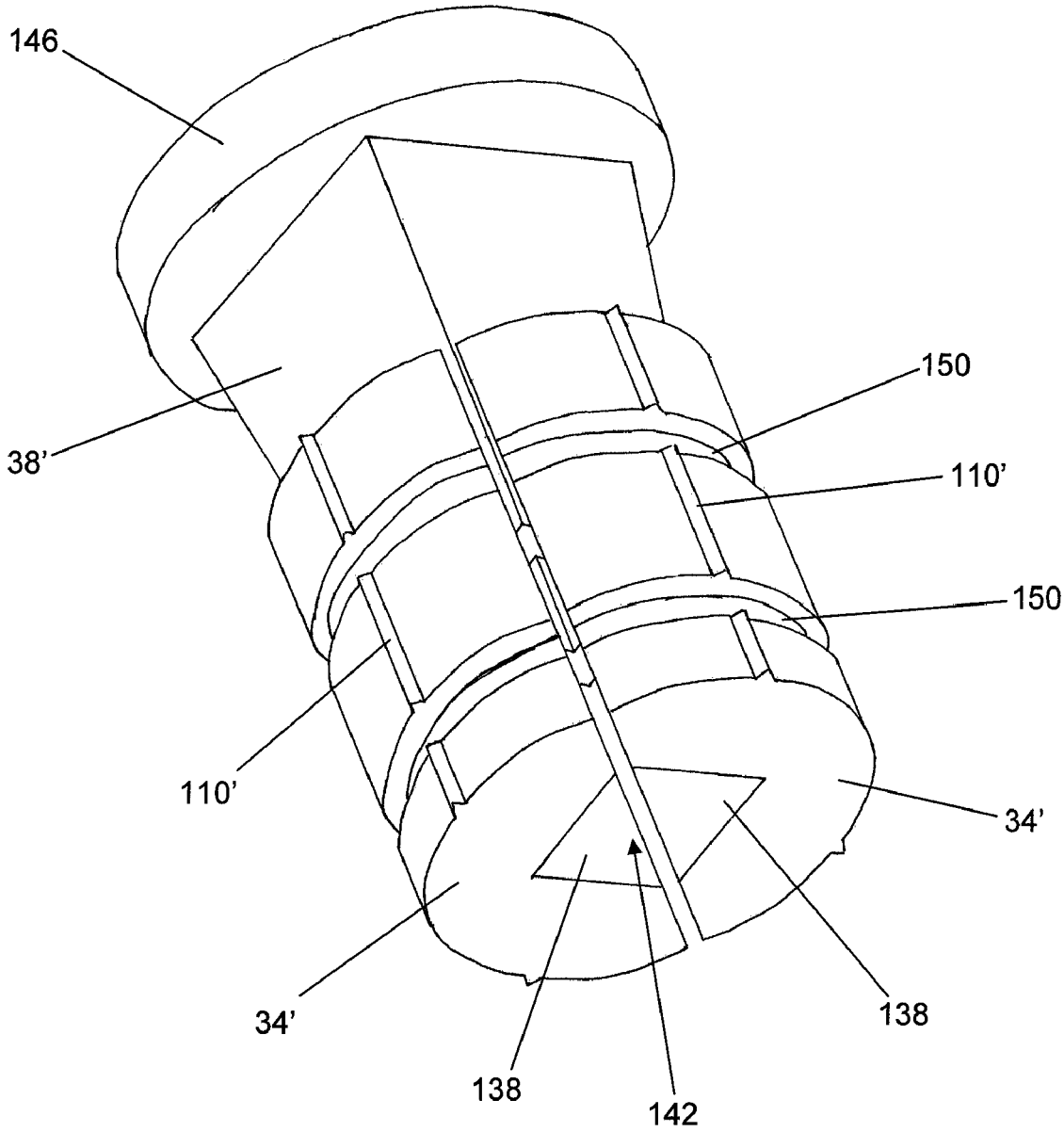
FIG. 13 shows a perspective view of an alternate embodiment of wrench jaws and wedge according to the present invention.

FIG. 13 shows an alternate configuration of wrench jaws and wedge which may be easier to manufacture for smaller diameter pipes, such as one half inch, one inch, etc. The configuration shown in FIGS. 1-12 may be more difficult to construct for smaller sizes. The wrench jaws 34' are shaped roughly as half cylinders, and typically have ridges or teeth 110' which grip the inside of a pipe riser and allow the riser to be extracted from a distribution pipe.

The wrench jaws 34' are formed with internal recesses 138 which define a tapering cavity 142 having a generally square cross section at any given point. The cavity 142 is smaller at one of the wrench jaws 34' and larger at the other end of the wrench jaws and configured to receive wedge 38' which also has a square shaped cross section. The wedge 38' is inserted into the wrench jaws 34'. The cavity 142 and wedge 38' have complementary shapes and tapers such that as the wedge 38' is drawn inwardly through the wrench jaws 34', the wrench jaws are pushed apart from each other and expanded into the interior bore of a pipe. The wedge 38' may have a base portion 146 which prevents the wedge from being drawn too far into the wrench jaws 34'.

The wrench jaws 34' are formed with grooves 150 which receive a circular biasing member such as an O-ring, circular spring, spring wire, etc. The circular biasing member pulls the wrench jaws 34' towards each other to release the jaws from the inside of the pipe when the wedge 38' is not being drawn upwardly into the wrench jaws. The square cross section of the cavity 142 and the wedge 38' prevent the wrench jaws 34' from simply rotating around the wedge when using the tool to unscrew a broken riser pipe. While discussed herein as square, other cross section shapes can be used to prevent slipping.

Figure 14:
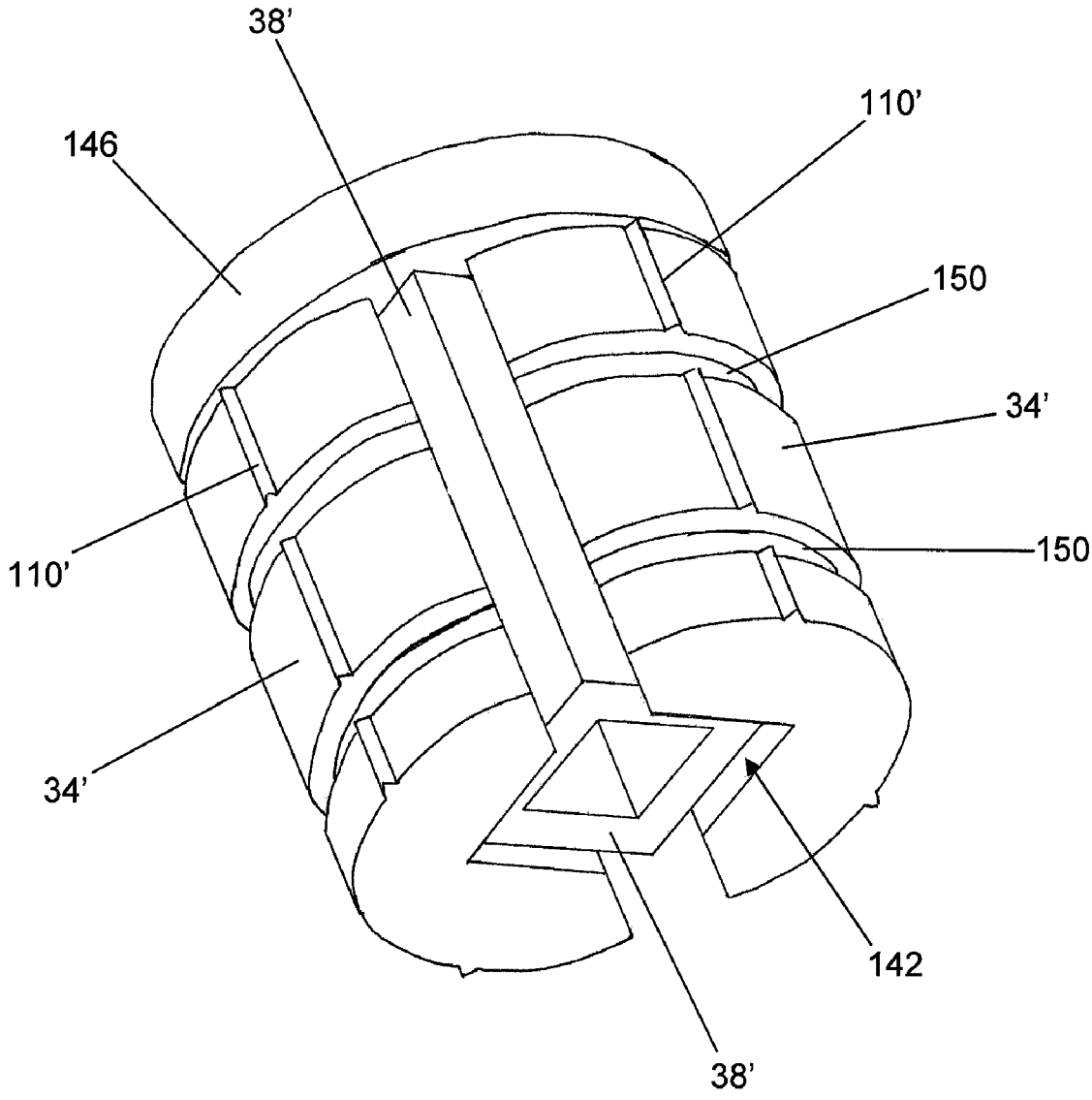
FIG. 14 shows another perspective view of the jaws and wedge of FIG. 13.

FIG. 14 shows another view of the wedge 38' and wrench jaws 34' of FIG. 13 wherein the wedge has been drawn inwardly between the wrench jaws to force the wrench jaws apart so as to grip the inside of a pipe. It is appreciated how the expansion of the wrench jaws 34' will be resisted by the biasing member (not shown) which is placed in grooves 150 such that the biasing member will pull the wrench jaws back together when the wedge 38' is not drawn upwardly between the wrench jaws.

FIG. 14 illustrates how the wedge 38' may have a square hole formed therein for allowing a draw bar or screw (not shown, similar to screw 42) to pass therethrough. The draw bar or screw typically passes through the wedge 38' and is used to pull the wrench jaws 34' towards the wedge 38'. The wedge 38' is attached to the stem of pipe extraction tool so as to rotate with the tool, causing the wrench jaws 34' to rotate with the tool.

Figure 15:
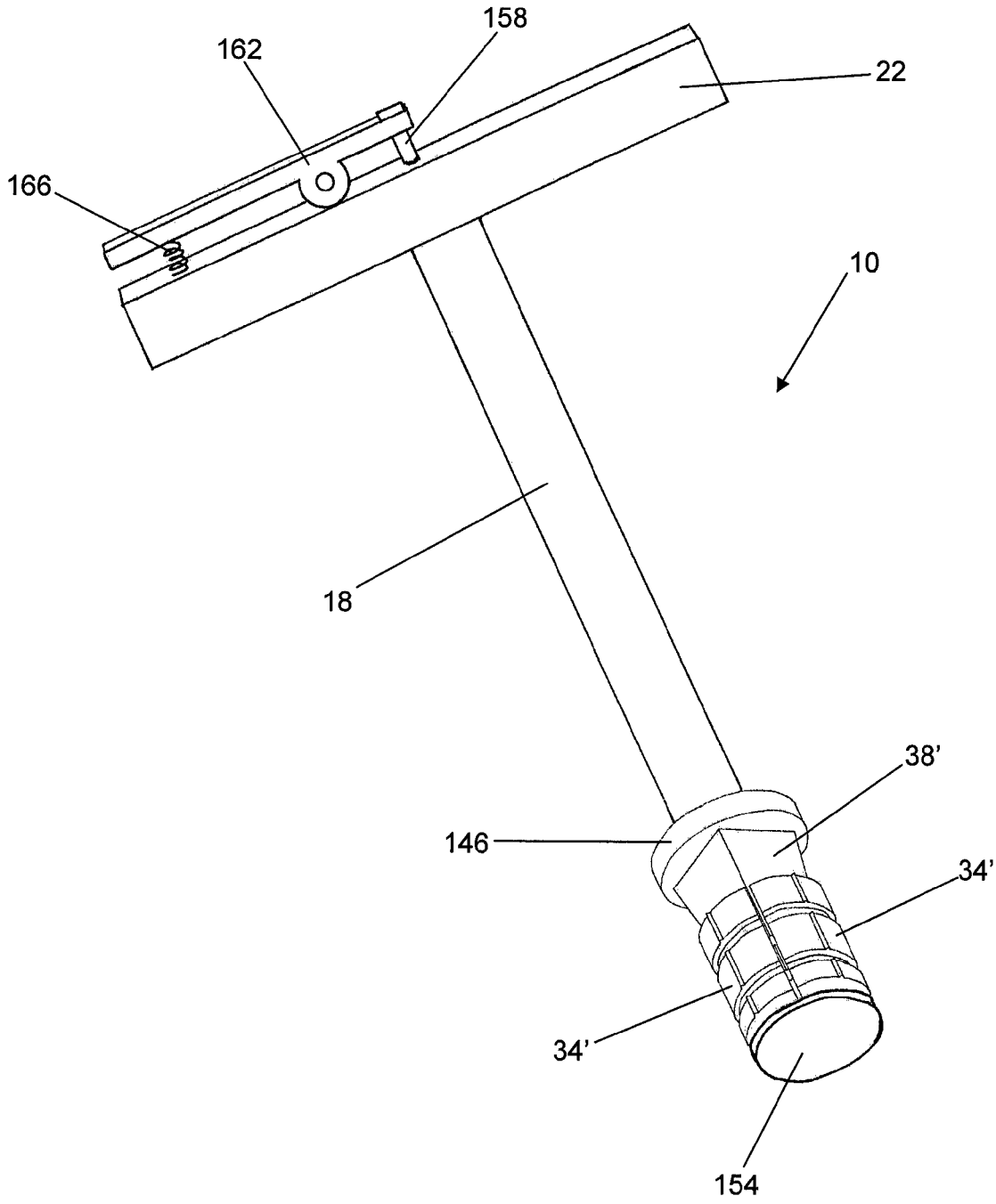
FIG. 15 shows a perspective view of a wrench having the jaws and wedge of FIG. 13.

FIG. 15 shows a pipe extraction tool 10' having the wrench jaws 34' and wedge 38' of FIG. 13. The tool 10' includes a handle 22 and stem 18 as have been discussed. base portion 146 of the wedge 38' is attached to the stem 18 and prevents excessive upward motion of the wrench jaws 34' when the wrench jaws are drawn upwardly by the draw bar 158 and base plate 154. The action of the base plate 154 and draw bar 158 moving the wrench jaws 34' upwardly causes expansion of the wrench jaws 34' as has been discussed. The base portion 146 of the wedge 38' may also form a depth stop to ensure that the tool is not inserted too far into a riser pipe. The draw bar 158 passes through the handle 22, stem 18, and wedge 38', and is connected to the base plate 154 to allow pulling of the wrench jaws upwardly onto the wedge. A lever 162 is pivotably mounted to the handle 22 and is used to pull the draw bar 158 upwardly relative to the tool 10' and thereby extend the wrench jaws 34' to engage the bore of a pipe.

It will be appreciated that a screw and screw nut such as screw 42 and screw nut 46 shown previously may be used instead of a draw bar 158 and lever 162, and that a draw bar and lever may equally be used in the wrench shown in FIGS. 1-12.

The wrench is used in the manner discussed above. The wrench jaws 34' are placed into a riser pipe which is to be extracted. The lever 162 is then moved to pull the draw bar 158 and base plate 154 upwardly and expand the wrench jaws 34' to grip the pipe. The handle 22 is then turned to extract the riser pipe. The lever 162 is then released to allow the draw bar 158, base plate 154, and wrench jaws 34' to move downwardly and release the engagement of the wrench jaws 34' and the pipe riser. A spring 166 or other biasing element may be used (in the grooves formed in the wrench jaws) to aid in releasing the wrench jaws 34'.

There is thus disclosed an improved pipe extraction tool. It will be appreciated that numerous changes may be made to the present invention without departing from the scope of the claims.

What is claimed is:

1. A pipe extraction tool comprising:

a stem having a first end and a second end;

a tapered wedge attached to the first end of the stem;

a plurality of wrench jaws disposed adjacent the first end of the stem and being configured for insertion into the bore of a pipe and configured to grip the bore of the pipe to allow the tool to rotate the pipe, the plurality of wrench jaws having an angled inner surface for engaging the wedge, wherein the plurality of wrench jaws are slidable in a direction parallel to the stem towards the second end to thereby expand the plurality of wrench jaws radially to grip the bore of a pipe, wherein the tapered wedge is in a fixed position relative to the stem, and further comprising a draw bar which is generally concentric to the stem, wherein the draw bar passes through the stem and the wedge and is connected to a base plate, the base plate being disposed adjacent the plurality of wrench jaws such that movement of the draw bar in a direction parallel to the to the axis of the stem and towards the second end of the stem moves the plurality of wrench jaws in said direction such that the plurality of wrench jaws interact with the tapered wedge to thereby move the plurality of wrench jaws outwardly in a direction generally perpendicular to the axis of the stem.

2. The tool of claim 1, further comprising a biasing element disposed around the plurality of wrench jaws for biasing the plurality of wrench jaws inwardly towards the axis of the stem.

3. The tool of claim 1, wherein the outer surface of the tapered wedge is disposed at generally the same angle as the angled inner surfaces of the plurality of wrench jaws, and wherein the plurality of wrench jaws slide across the outer surface of the tapered wedge.

4. The tool of claim 1, further comprising a stop for limiting the distance that the plurality of wrench jaws are drawn upwardly by the draw bar.

5. The tool of claim 1, further comprising a handle attached to the second end of the stem to thereby facilitate rotation of the tool.

6. The tool of claim 1, wherein the tool is configured for transmitting a rotational force to the pipe.

* * * * *